US007330674B2

(12) United States Patent
Ahn et al.

(10) Patent No.: US 7,330,674 B2
(45) Date of Patent: Feb. 12, 2008

(54) IMAGE FORMING APPARATUS FOR PREVENTING RESISTANCE VARIATION OF INTERMEDIATE TRANSFER BELT AND METHOD THEREOF

(75) Inventors: Myung-kook Ahn, Suwon-si (KR); In-yong Song, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 181 days.

(21) Appl. No.: 11/238,063

(22) Filed: Sep. 29, 2005

(65) Prior Publication Data

US 2006/0072932 A1 Apr. 6, 2006

(30) Foreign Application Priority Data

Oct. 4, 2004 (KR) ..... 10-2004-0078679

(51) Int. Cl.
*G03G 15/16* (2006.01)

(52) U.S. Cl. ..... 399/66; 399/297; 399/300

(58) Field of Classification Search ..... 399/66, 399/297, 299, 300, 302, 308, 310, 313, 314
See application file for complete search history.

(56) References Cited

U.S. PATENT DOCUMENTS

2002/0034407 A1* 3/2002 Takahashi ..... 399/303
2005/0058473 A1* 3/2005 Mizuno et al. ..... 399/302

FOREIGN PATENT DOCUMENTS

| | | |
|---|---|---|
| JP | 05-016411 | 1/1993 |
| JP | 08-258313 | 10/1996 |
| JP | 11-320934 | 11/1999 |
| JP | 2000-056589 | 2/2000 |
| JP | 2000-168111 | 6/2000 |
| JP | 2001-125338 | 5/2001 |
| JP | 2003-035986 | 2/2003 |
| KR | 10-2004-0053675 | 6/2004 |

* cited by examiner

*Primary Examiner*—David M. Gray
*Assistant Examiner*—Ryan D. Walsh
(74) *Attorney, Agent, or Firm*—Roylance, Abrams, Berdo & Goodman, L.L.P.

(57) ABSTRACT

An image forming apparatus for performing a printing job using an intermediate transfer belt is provided. The image forming apparatus has a voltage determination part for determining a predetermined level of a refresh charge corresponding to a potential difference which is generated on opposite surfaces of the intermediate transfer belt, and a power supply for supplying the refresh charge to the intermediate transfer belt so that the potential difference is offset. The power supply supplies the refresh charge to the intermediate transfer belt through a certain roller which is in contact with the intermediate transfer belt. Accordingly, the potential difference caused by the polarization in the intermediate transfer belt is offset by the refresh charge, and the variation of the resistance caused by the potential difference is prevented.

13 Claims, 8 Drawing Sheets

(a)

(b)

IMAGE FORMING APPARATUS FOR PREVENTING RESISTANCE VARIATION OF INTERMEDIATE TRANSFER BELT AND METHOD THEREOF

PRIORITY

This application claims the benefit under 35 U.S.C. § 119(a) of Korean Patent Application No. 2004-78679, filed on Oct. 4, 2004, the entire contents of which are incorporated herein by reference.

BACKGROUND OF THE INVENTION

1. Field of the Invention

The present invention relates to an image forming apparatus which uses an intermediate transfer belt and a method thereof. More particularly, the present invention relates to an image forming apparatus which is capable of preventing a resistance of an intermediate transfer belt from varying by using a refresh charge supplied to the intermediate transfer belt.

2. Description of the Related Art

With the development of electronic technology, peripherals for computers, such as printers or scanners, are increasingly utilized. While printer manufacturers have invested in development of various printers, laser printers have risen to prominence in recent years. Laser printers have distinguishable advantages over from dot printers or ink-jet printers such has improved print quality, print speed, and noise reduction. Laser printers use a principle that attracts toners to a drum by using laser beams converted into an image signal and fuses the toners to paper with high temperature heats.

The laser printer prints an image through a series of processes, i.e., charging, writing, developing, transferring, and fusing. The charging process supplies a high voltage (approximately 7000V) to a charger and forms a negative (−) electric charge on a surface of the drum by a corona discharge. The writing process scans the surface of the drum, on which the negative (−) electric charge is formed, with laser beams and removes the negative (−) electric charge in the form of text, thereby forming a latent image. The developing process rotates a developing roller and the drum with a predetermined gap therebetween, thereby attracting toner particles having a negative (−) property to the latent image. The transferring process supplies a predetermined transfer voltage to a transferring medium when paper passes between the drum and the transferring medium and forms a positive (+) electric charge on the backside of the paper, thereby transferring the negative (−) toner particles formed on the surface of the drum to the paper. The fusing process applies heat and pressure to a toner image formed on the paper and fuses the toner image onto the paper. Through the above-described processes, an image is formed on the paper and output.

In color printers, toners having the four colors of cyan, magenta, yellow, black are used to obtain a color image. In order to obtain a more vivid color image, four photoconductors are used, and printing operations are performed by color toners. Also, the transferring process uses an intermediate transfer belt and performs two steps to output the respective color toners to appropriate positions.

FIG. 1 is a view showing a general image forming apparatus which performs a transferring process by using an intermediate transfer belt and through two steps. Referring to FIG. 1, the image forming apparatus comprises an intermediate transfer belt 10, a pre-cleaning roller 20, a driving roller 25, four first transfer units 30, 40, 50, 60, four respective photoconductors 35, 45, 55, 65, a second transfer backup roller 70, and a second transfer unit 75.

The driving roller 25 moves the intermediate transfer belt 10 at a proper speed, and the pre-cleaning roller 20 cleans off toners being left on a surface of the intermediate transfer unit 10 before the toners are removed by a cleaning blade 23.

The first transfer units 30, 40, 50, 60 correspond to the first to fourth photoconductors 35, 45, 55, 65, respectively, and the intermediate transfer belt 10 is located therebetween. Accordingly, the first transfer units and the photoconductors transfer their respective toners, each having one of black, cyan, magenta, and yellow, respectively, to the intermediate transfer unit 10. That is, toners having colors of black, cyan, magenta, and yellow are attracted to respective ones of the photoconductors 35, 45, 55, 65 during the developing process, and then transferred to the intermediate transfer belt 10 by the first transfer units 30, 40, 50, 60. In this case, the image forming apparatus recognizes location marks formed on the intermediate transfer belt 10 and synchronizes operations of the photoconductor 35, 45, 55 and 65 and the first transfer units 30, 40, 50, 60 so that one color image is formed.

Meanwhile, when the paper is conveyed in an arrowed direction as shown in FIG. 1, the color image is transferred from the surface of the intermediate transfer belt 10 to the paper 80 by a second transferring process, which is performed between the second transfer backup roller 70 and the second transfer unit 75.

FIG. 2 is a cross-section view showing the intermediate transfer belt 10. Referring to FIG. 2, the intermediate transfer belt 10 is comprised of a coating layer 11, a urethane rubber layer 12, and a base layer 13. The urethane rubber layer 12 and the base layer 13 contribute to the improved durability of the intermediate transfer belt 10, and the coating layer 11 contributes to the gain of a vivid color image. The first transfer units 30, 40, 50, 60 and the photoconductors 35, 45, 55, 65 are in close contact with upper and lower surface of the intermediate transfer belt 10, respectively, to transfer color toners to the intermediate transfer belt 10. For this, a transfer voltage is supplied between the first transfer units 30, 40, 50, 60 and the photoconductors 35, 45, 55, 65 to transfer the color tones to the intermediate transfer belt 10. In this case, a potential difference of approximately 500V to 600V is generated on the upper and lower surfaces of the intermediate transfer belt 10. When the first transferring process is completed, the transfer voltage is stopped. Thus, the potential difference on the upper and lower surfaces of the intermediate transfer belt 10 disappears in a normal case, that is, when no transfer process is occurring.

However, as the number of printed copies increases, electric charges existing in the urethane rubber layer 12 of the intermediate transfer belt 10 do not recombine to each other, which is referred to as a polarization effect. As shown in FIG. 2, the negative (−) electric charge in the urethane rubber layer 12 is aligned along a boundary "a" between the urethane rubber layer 12 and the coating layer 11, whereas the positive (+) electric charge is aligned along a boundary "b" between the urethane rubber layer 12 and the base layer 13. Therefore, although the transfer voltage is not supplied, a predetermined potential difference Vp is still generated in the upper and lower surfaces of the intermediate transfer belt. As a result of the polarization, a resistance of the intermediate transfer belt 10 increases.

FIGS. 3A and 3B are graphs explaining the polarization effect and the increase of the resistance which are caused as the number of printed copies increases. In detail, FIG. 3A is a graph showing a variation of a voltage measured at opposite ends of the intermediate transfer belt 10. FIG. 3A shows a first curve 310 indicating a variation of a voltage measured in an initial state of the image forming apparatus, and a second curve 320 indicating a variation of a voltage measured after the image forming apparatus outputs 5000 or more copies. According to the first curve 310, when a transfer voltage of 500V is stopped, a potential difference generated on opposite surfaces of the intermediate transfer belt 10 abruptly decreases to 0V. According to the second curve 320, although the transfer voltage of 500V is stopped, a potential difference of approximately 200V remains. A predetermined voltage still remains on the intermediate transfer belt 10 due to the polarization. Accordingly, if a transfer voltage having the same level as in the initial state is supplied, the transferring process is not normally performed.

FIG. 3B is a graph showing a relationship between a resistance and the number of printed copies. Referring to FIG. 3B, the intermediate transfer belt 10 has a resistance of approximately 25MO in an initial state. However, at the time of printing of thirty thousand copies, the resistance increases to 337MO, and at the time of printing of fifty thousand copies, the resistance increases to 474MO. When the resistance abruptly increases, the level of the transfer voltage must increase to maintain a transfer quality. As the transfer voltage increases, the polarization becomes more significant, and thus the resistance of the intermediate transfer belt 10 increases more rapidly. As a result, a lifespan of the intermediate transfer belt 10 is reduced, and power consumption increases.

Although the level of the transfer voltage increases to compensate for the variation of the resistance, proper conditions for the transferring process may not be present, thereby deteriorating image quality.

A need therefore exists for an image forming apparatus that overcomes the problems associated with polarization of the transfer belt.

SUMMARY OF THE INVENTION

The present invention has been developed in order to overcome the above-described problems in the related art. Accordingly, an aspect of the present invention is to provide an image forming apparatus which prevents a resistance of an intermediate transfer belt from varying by using a predetermined level of a refresh charge supplied to the intermediate transfer belt, thereby maintaining an optimal condition for transferring, and a method thereof.

The above exemplary aspect is achieved by providing an image forming apparatus for performing a printing job using an intermediate transfer belt. The image forming apparatus comprises a refresh charge determination part for determining a predetermined level of a refresh charge corresponding to a potential difference which is generated on opposite surfaces of the intermediate transfer belt, and a power supply for supplying the refresh charge to the intermediate transfer belt so that the potential difference is offset.

In accordance with another aspect of the present invention, the illustrative image forming apparatus may further comprise at least one photoconductor, at least one first transfer unit for transferring a toner image developed on the at least one photoconductor to a surface of the intermediate transfer belt, and a second transfer unit for transferring the toner image transferred to the surface of the intermediate transfer belt to a predetermined paper.

In accordance with another aspect of the present invention, the exemplary image forming apparatus may further comprise a resistance measurement part for measuring a resistance of the intermediate transfer belt, and a transfer signal determination part for determining a magnitude of a transfer signal, which is supplied to the first and the second transfer units to form an electric field for performing a transferring operation, according to the resistance of the intermediate transfer belt.

In accordance with another aspect of the present invention, the exemplary refresh charge determination part may determine a level of the refresh charge according to the magnitude of the transfer signal determined by the transfer signal determination part. The refresh charge determination part increases the level of the refresh charge if the magnitude of the transfer signal determined by the transfer signal determination part increases, and decreases the level of the refresh charge if the magnitude of the transfer signal determined by the transfer determination part decreases.

In accordance with another aspect of the present invention, the exemplary image forming apparatus may further comprise a memory for storing information about the refresh charge corresponding to the magnitude of the transfer signal. In this case, the refresh charge determination part reads out from the memory the refresh charge corresponding to the transfer signal determined by the transfer signal determination part.

In accordance with another aspect of the present invention, the exemplary image forming apparatus may further comprise a roller being supplied with the refresh charge from the power supply and transmitting the refresh charge to the intermediate transfer belt.

In accordance with another aspect of the present invention, the exemplary image forming apparatus may further comprise a pre-cleaning roller for removing toners left on a surface of the intermediate transfer belt. In this case, the power supply supplies the refresh charge to the intermediate transfer belt through one of the pre-cleaning roller, the first transfer unit and the second transfer unit.

According to an exemplary embodiment, a transferring method of an image forming apparatus which performs a transferring operation using an intermediate transfer belt is provided, wherein the method comprises (a) determining a predetermined level of a refresh charge corresponding to a potential difference which is generated on opposite surfaces of the intermediate transfer belt, and (b) supplying the refresh charge to the intermediate transfer belt so that the potential difference is offset.

In accordance with another aspect of the present invention, the exemplary method may further comprise measuring a resistance of the intermediate transfer belt; determining a magnitude of a first transfer signal according to the resistance of the intermediate transfer belt, the first transfer signal being supplied to a first transfer unit for transferring a predetermined toner to one surface of the intermediate transfer belt, and determining a magnitude of a second transfer signal according to the resistance of the intermediate transfer belt, the second transfer signal being supplied to a second transfer unit for transferring the toner transferred to the one surface of the intermediate transfer belt to a paper, In accordance with another aspect of the present invention, the step (a) may determine the level of the refresh charge according to the magnitude of at least one of the first and the second transfer signals.

The exemplary method may further comprise checking a variation in the magnitude of the transfer signal at predetermined intervals, increasing the level of the refresh charge if the magnitude of the transfer signal increases, and decreasing the level of the refresh charge if the magnitude of the transfer signal decreases.

In accordance with another aspect of the present invention, the step (b) may supply the refresh charge to at least one of a pre-cleaning roller for removing a toner left on a surface of the intermediate transfer belt, the first transfer unit, the second transfer unit, and a predetermined roller being in contact with the intermediate transfer unit so that a potential difference of the intermediate transfer unit is offset.

In accordance with another aspect of the present invention, the step (a) may determine the refresh charge using a data table on which information about the refresh charge corresponding to the first transfer signal and the second transfer signal is recorded.

BRIEF DESCRIPTION OF THE DRAWINGS

These and other exemplary aspects and advantages of the present invention will become apparent and more readily appreciated from the following description of the exemplary embodiments, taken in conjunction with the accompanying drawings, in which.

Throughout the drawings, like reference numerals will be understood to refer to like parts, components and structures.

DETAILED DESCRIPTION OF EXEMPLARY EMBODIMENTS

The present invention will now be described in greater detail with reference to the accompanying drawings.

Figure 1:
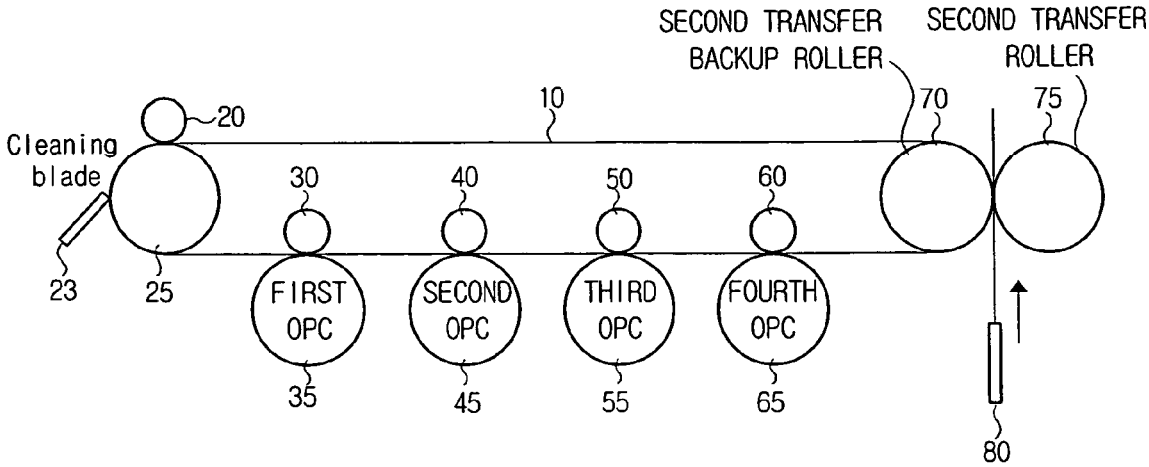
FIG. 1 (PRIOR ART)
FIG. 1 is a view showing a conventional image forming apparatus using an intermediate transfer belt.
Figure 2:
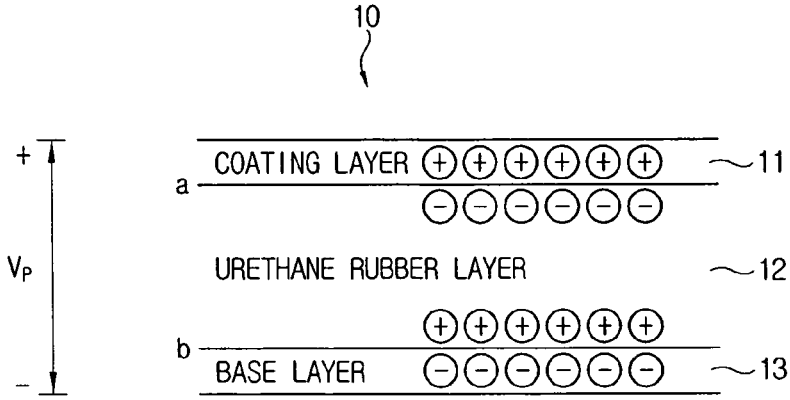
FIG. 2 (PRIOR ART)
FIG. 2 is a view showing the intermediate transfer belt of FIG. 1.
Figure 3:
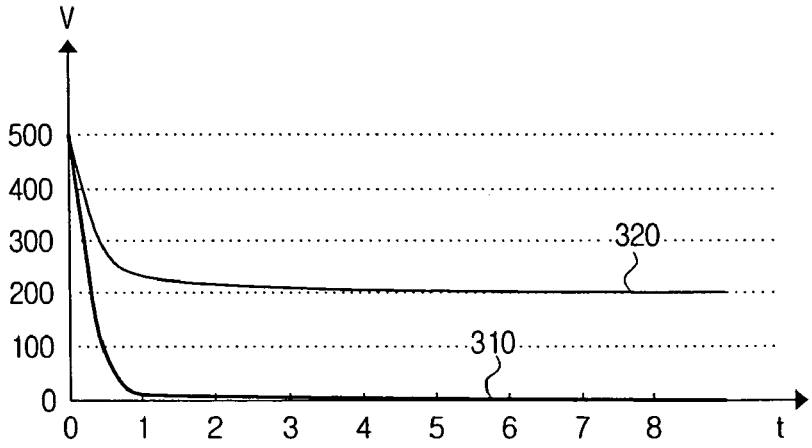
FIG. 3 (PRIOR ART)
FIGS. 3A and 3B are graphs showing variations in a resistance value caused by polarization.
Figure 3:
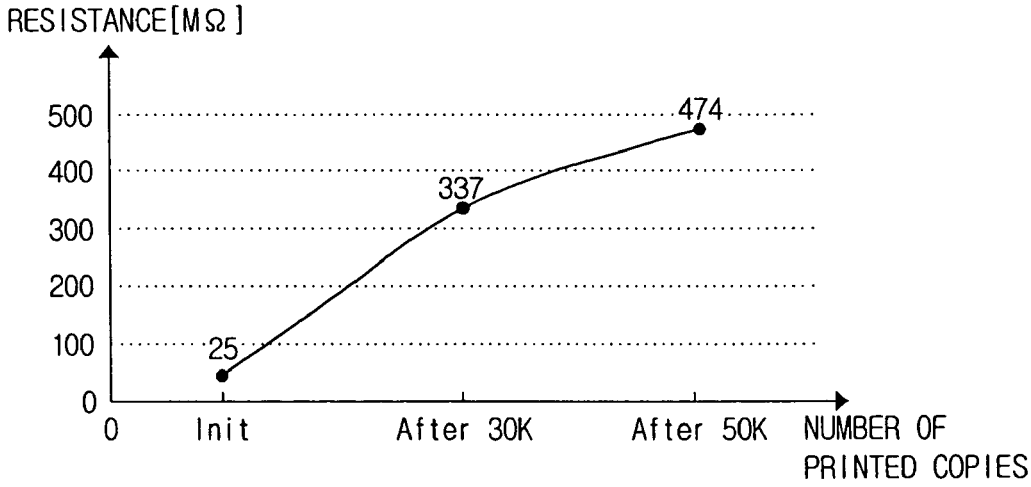
FIG. 3 (PRIOR ART)
Figure 4:
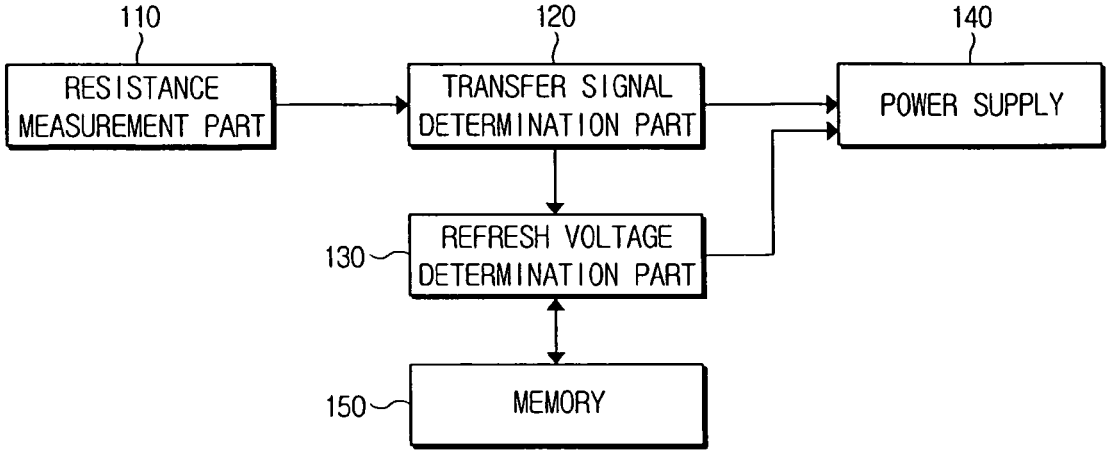
FIG. 4 is a block diagram showing an image forming apparatus according to an embodiment of the present invention.

FIG. 4 is a block diagram showing an image forming apparatus according to an embodiment of the present invention. Referring to FIG. 4, the image forming apparatus according to the present invention comprises a resistance measurement part 110, a transfer signal determination part 120, a refresh charge determination part 130, a power supply 140, and a memory 150.

The resistance measurement part 110 measures a resistance of an intermediate transfer belt (ITB) used in the image forming apparatus. More specifically, the resistance measuring part 110 supplies a test voltage $V_T$ between a first transfer unit and a photoconductor which are in close contact with the ITB or between a second transfer unit and a second transfer backup roller, and detects an electrical value, thereby measuring the resistance of the ITB.

The transfer signal determination part 120 supplies the first and the second transfer units with a transfer signal having a magnitude corresponding to the resistance measured by the resistance measurement part 110. The transfer signal is a transfer voltage or a transfer current according to a driving method.

The power supply 140 supplies the first and the second transfer units with the transfer voltage or the transfer current determined by the transfer signal determination part 120.

The refresh charge determination part 130 determines a level of a refresh charge according to the magnitude of the transfer signal determined by the transfer signal determination part 120. The resistance of the ITB varies depending on a potential difference generated in the ITB due to a polarization. Accordingly, the magnitude of the transfer signal determined by the transfer signal determination part 120 varies depending on the potential difference generated in the ITB. The potential difference increases during a prolonged use of the image forming apparatus, i.e., as the number of printed copies increases. The refresh charge determination part 130 determines the level of the refresh charge so that the potential difference is offset by the refresh charge. As a result, the resistance of the ITB can be essentially constantly maintained. In this case, the level of the refresh charge is adjusted by checking variations of the transfer signal.

The refresh charge may use only a DC voltage or may use both an AC voltage having a predetermined amplitude and a predetermined frequency and a DC offset. If the refresh charge uses only the DC voltage, the refresh charge can be easily applied to the image forming apparatus. On the other hand, if the refresh charge is an AC voltage having a DC offset level, a remarkable effect of the refresh charge can be obtained. The two types of refresh charge are selectively used according to characteristics of apparatus. If the AC refresh charge having a DC offset level is used, it is preferable that a maximum amplitude of the AC voltage plus the DC offset does not exceed a set level of a second transfer voltage to obtain a normal image.

In order to determine an optimal level of a refresh charge according to the magnitude of the transfer signal, a predetermined equation is used. A method of calculating the optimal level of the refresh charge will be described below.

The power supply 140 supplies the ITB with the level of the refresh charge determined by the refresh charge determination part 130 so that the potential difference can be offset by the refresh charge, and thus, the resistance is essentially constantly maintained. At this time, the refresh charge is supplied in a direction which is opposite to a supply direction of the transfer signal. Also, the refresh charge is supplied through a predetermined roller which is in contact with the ITB. The predetermined roller may be a pre-cleaning roller, a first transfer unit or a second transfer unit. Alternatively, a roller dedicated to the supply of refresh charge may be further provided. If the first and the second transfer units are used to supply the refresh charge, the refresh charge is supplied during a pause period, i.e., when a transferring process is stopped. In other words, the refresh charge is supplied in the direction opposite the supply direction of the transfer voltage to offset the potential difference.

However, if the first roller and the second roller are used to supply the refresh charge, the effect of the refresh charge deteriorates because the refresh charge is supplied only during the pause period. Also, if the dedicated roller is additionally provided, a cost-saving effect or a space-utilizing effect cannot be achieved. In view of these points, it is preferable to use the pre-cleaning roller.

According to another embodiment, the refresh charge determination part 130 does not calculate the refresh charge, but instead reads out a proper refresh charge from a data table stored in the memory. That is, the level of the refresh charge is determined based on a transfer signal and a level of a refresh charge corresponding to the transfer signal which were previously stored in the memory 150. Therefore, the calculation load of the refresh charge determination part 130 can be reduced.

Figure 5:
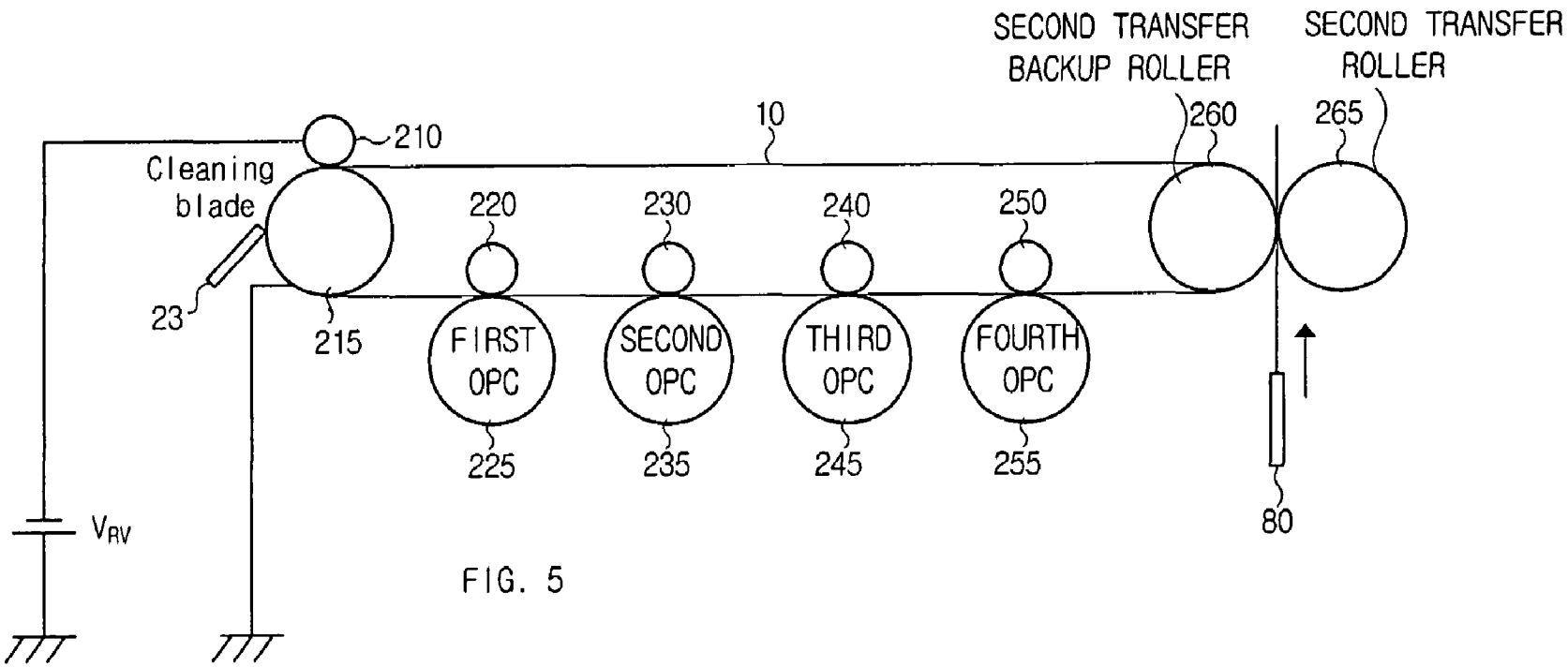
FIG. 5 is a cross-sectional schematic view showing a transferring unit used in the image forming apparatus of FIG. 4.

FIG. 5 is a view showing an ITB 10 and a transfer unit which are used in the image forming apparatus according to an embodiment of the present invention. In this embodiment, the exemplary transfer unit for a transferring process includes four first transfer units, four photoconductors, a second transfer unit, and a second transfer backup roller.

Referring to FIG. 5, a driving roller 215, a plurality of first transfer units 220, 230, 240, 250, and a second transfer backup roller 260 are arranged in contact with an inner surface of the ITB 10. Meanwhile, a pre-cleaning roller 210, a plurality of photoconductors 225, 235, 245, 255, and a second transfer unit 265 are arranged in contact with an outer surface of the ITB 10. The ITB is comprised of a plurality of material layers. More specifically, the ITB is comprised of a base layer, an intermediate layer, and an uppermost layer. The base layer uses a material that is robust against a tension which may be applied during an operation of the ITB. The intermediate layer uses a soft material that is deformable according to a characteristic of a paper surface to smoothly transfer toners on the ITB to paper. The uppermost layer uses a hard material that can withstand the angled abutment of a cleaning blade for removing toner left after the transferring process. By way of an example, the transfer signal for forming an electric field on the transfer unit is supplied in the form of voltage.

The driving roller 215 moves the ITB 10 in a predetermined direction. The plurality of first transfer units 220, 230, 240, 250 perform a first transferring process so that toner formed on surfaces of the photoconductors 225, 235, 245, 255 corresponding to the plurality of first transfer units 220, 230, 240, 250 are transferred to the ITB 10. For this, a first transfer voltage is supplied from the power supply 140. Although in this embodiment, four first transfer units 220, 230, 240, 250 are provided, the number of first transfer units is different depending on the kind of the image forming apparatus.

The second transfer unit 265 performs a second transfer process in cooperation with the second transfer backup roller 260 so that the toner transferred to the ITB 10 through the first transferring process is transferred to a paper 80. For this, a second transfer voltage is supplied from the power supply 140.

The refresh charge determination part 130 determines the level of refresh charge based on the level of the second transfer voltage supplied to the second transfer unit 265 using to the following Equation 1.

$$V_{RV} = \frac{V_{T2}}{2} \quad \text{[Equation 1]}$$

wherein $V_{RV}$ denotes a refresh charge and $V_{T2}$ denotes a second transfer voltage. The refresh charge obtained by the Equation 1 is referred to as a reference refresh charge and is supplied to the ITB 10 so that the potential difference formed on the ITB 10 is offset by the refresh charge.

The refresh charge determination part 130 determines a level of the first transfer voltage supplied to the first transfer unit during the printing process and adjusts the level of the refresh charge using the following Equation 2.

[Equation 2]

$$V_{RV}=V_{old\text{-}RV} \text{ (at } V_{T1}=V_{old\text{-}T1})$$

$$V_{RV}=V_{old\text{-}RV}-K(V_{T1}-V_{old\text{-}T1}) \text{ (at } V_{T1}<V_{old\text{-}T1})$$

$$V_{RV}=V_{old\text{-}RV}+K(V_{T1}-V_{old\text{-}T1}) \text{ (at } V_{T1}>V_{old\text{-}T1})$$

wherein $V_{T1}$ denotes a first transfer voltage, $V_{old\text{-}T1}$ denotes a previous first transfer voltage, $V_{RV}$ denotes a refresh charge, $V_{old\text{-}RV}$ denotes a previous refresh charge, and K denotes a proportional constant. K is arbitrarily set in a range so that the maximum refresh charge does not exceed a transfer voltage T2. For example, K is set to '2'. If the first transfer voltage is identical to the previous first transfer voltage, the refresh charge is maintained, and if the first transfer voltage is less than the previous first transfer voltage, the refresh charge is decreased. If the first transfer voltage is greater than the previous first transfer voltage, the refresh charge is increased. The adjust amount is determined depending on the number of the first transfer units 220, 230, 240 and 250. In Equation 2, if K is '2', a value obtained by multiplying a variation amount of the transfer voltage by 2 is the adjustment amount of the refresh charge.

The power supply 140 supplies the refresh charge $V_{RV}$ determined by the refresh charge determination part 130 to the ITB 10. As shown in FIG. 5, the refresh charge $V_{RV}$ is supplied to the pre-cleaning roller 210 such that the driving roller 215 is grounded. Consequently, the refresh charge $V_{RV}$ is supplied in a direction which is opposite to a direction of the potential difference formed on the ITB so the potential difference is offset by the refresh charge, and thus, the resistance of the ITB can be constantly maintained.

The power supply 140 may supply the refresh charge through one of the first transfer units 225, 235, 245, 255 or the second transfer unit 265 instead of the pre-cleaning roller 210. Alternatively, it is possible that the refresh charge is supplied through an extra roller (not shown).

Figure 6:
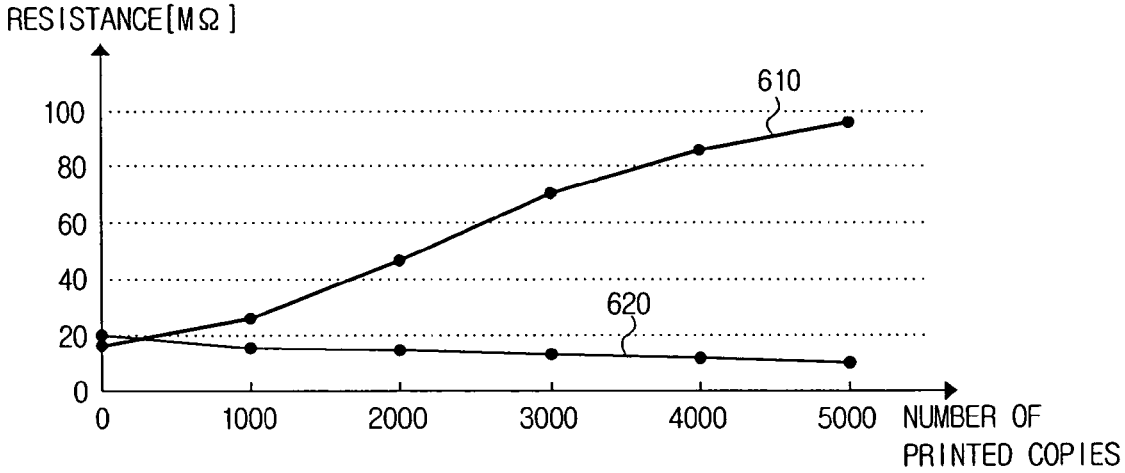
FIG. 6 is a graph showing a relationship between a refresh charge and a resistance value according to an embodiment of the present invention.

FIG. 6 is a graph showing a relationship between the resistance and the number of printed copies when a predetermined level of refresh charge is supplied. In FIG. 6, a curve 610 indicates a relationship between the resistance and the number of printed copies if the refresh charge of 1 kV is supplied, and a curve 620 indicates a relationship between the resistance and the number of printed copies if the refresh charge of 2 kV is supplied. As shown in FIG. 6, if 1 kV is supplied, the resistance increases as the number of printed copies increases. In other word, the potential difference of the ITB is not completely offset by the refresh charge of 1 kV. On the other hand, if the refresh charge of 2 kV is supplied, the resistance decreases as the number of printed copies increases. In other words, the refresh charge of 2 kB has a greater value than the potential difference of the ITB 10. Subsequently, the ITB 10 is subjected to a predetermined level of a reverse voltage and, in order to maintain an appropriate condition, the transfer voltage has to be reduced. However, in this case, image quality deteriorates since the appropriate condition for transferring cannot be satisfied.

Therefore, the refresh charge determination 130 adjusts the level of the refresh charge according to the variations of the resistance. That is, in order to maintain the resistance constant, the refresh charge is adjusted to a value ranging from 1 kV to 2 kV.

Figure 7:
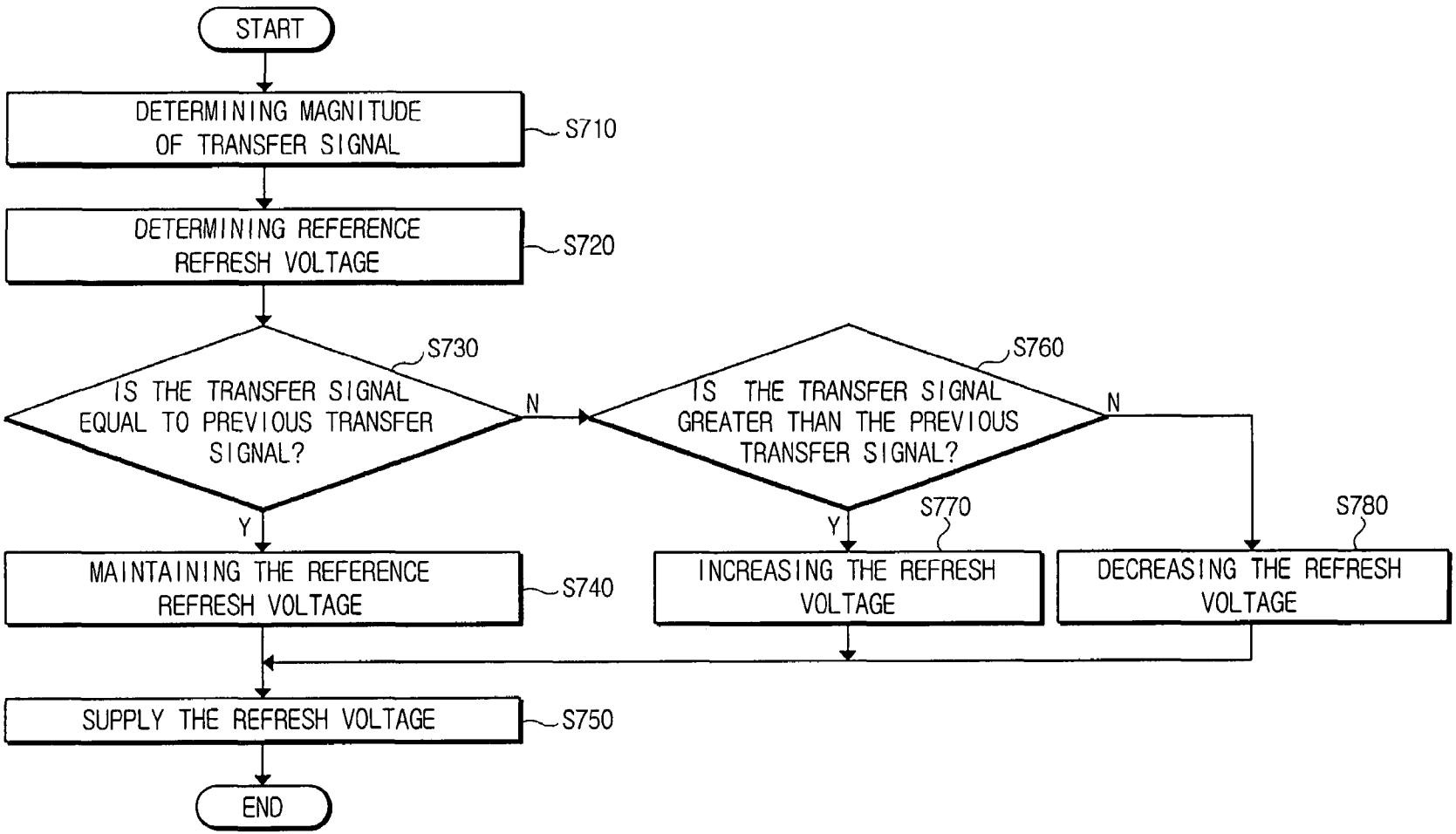
FIG. 7 is a flowchart showing a transferring method of an image forming apparatus according to an embodiment of the present invention.

FIG. 7 is a flowchart illustrating a transferring method of the image forming apparatus according to an embodiment of the present invention. Referring to FIG. 7, a magnitude of a transfer signal (i.e., a transfer voltage or transfer current) is recognized at step S710. The level of the transfer voltage or transfer current supplied to a first transfer unit or a second transfer unit is determined according to the resistance.

Next, a reference refresh charge is set at step S720. The reference refresh charge may be set according to the determined level of transfer voltage. Alternatively, the reference refresh charge is a default voltage stored in the memory 150.

At step S730, it is determined whether the determined magnitude of transfer signal is identical to a previous transfer signal (i.e., whether there is a change in the transfer signal).

If the determined magnitude of the transfer signal is identical to the previous transfer signal, the reference refresh charge is maintained at step S740 and supplied to the ITB 10 at step S750.

If the transfer signal is greater than the previous transfer signal at step S760, the refresh charge is increased at step S770, and then is supplied to the ITB 10 at step S750.

If the transfer signal is less than the previous transfer signal at step S760, the refresh charge is decreased at step S780 and then is supplied to the ITB 10 at step S750. Accordingly, the resistance of the ITB 10 is prevented from varying so that a normal transferring process can be performed.

Figure 8:
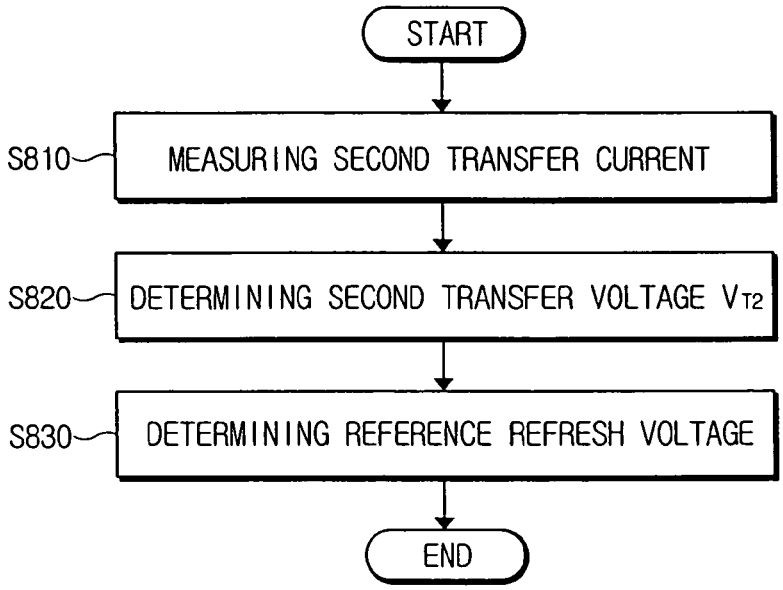
FIG. 8 is a flowchart showing a method of determining a reference refresh charge according to an embodiment of the present invention.

FIG. 8 is a flowchart showing a method of setting the reference refresh charge in detail. Referring to FIG. 8, a second transfer current flowing through the second transfer unit 265 and the second transfer backup roller 260 is measured at step S810. A second transfer voltage is determined according to the measured second transfer current at step S820. In this case, the second transfer voltage is determined based on the second transfer current and a proper second transfer voltage corresponding to the second transfer current which are stored in the memory 150 in the form of a data table, for example.

The reference refresh charge is determined by dividing the second transfer voltage by 2 at step S830.

Figure 9:
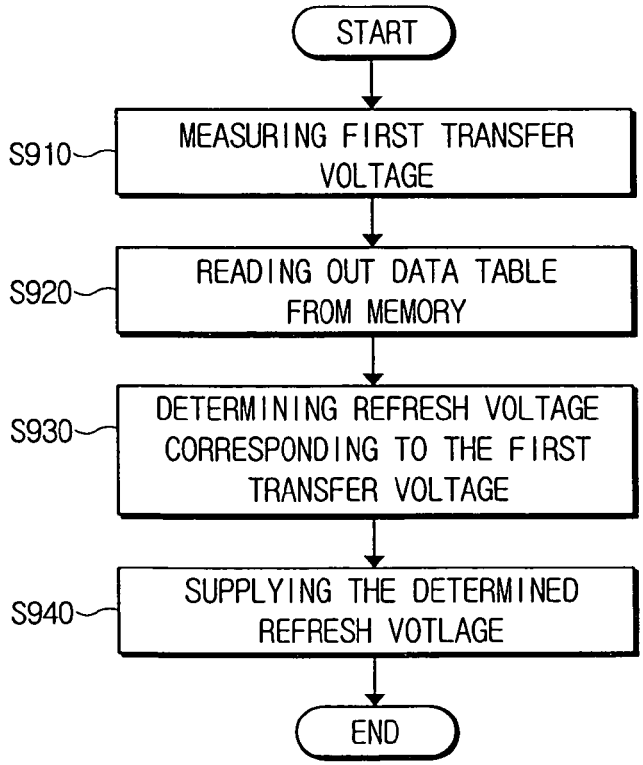
FIG. 9 is a flowchart showing a transferring method of an image forming apparatus according to another embodiment of the present invention.

FIG. 9 is a flowchart showing a transferring method of an image forming apparatus according to another embodiment. Referring to FIG. 9, a first transfer voltage being supplied to a first transfer unit is determined at step S910. A data table is read out from a memory 150 at step S920, and a refresh charge is determined according to the first transfer voltage at step S930. For this, the first transfer voltage and the refresh charge corresponding to the first transfer voltage are previously stored in the memory 150. The determined refresh charge is supplied to an ITB 10 at step S940.

Since a potential difference generated on the ITB 10 is offset by the refresh charge, a resistance can be essentially constantly maintained.

Figure 10:
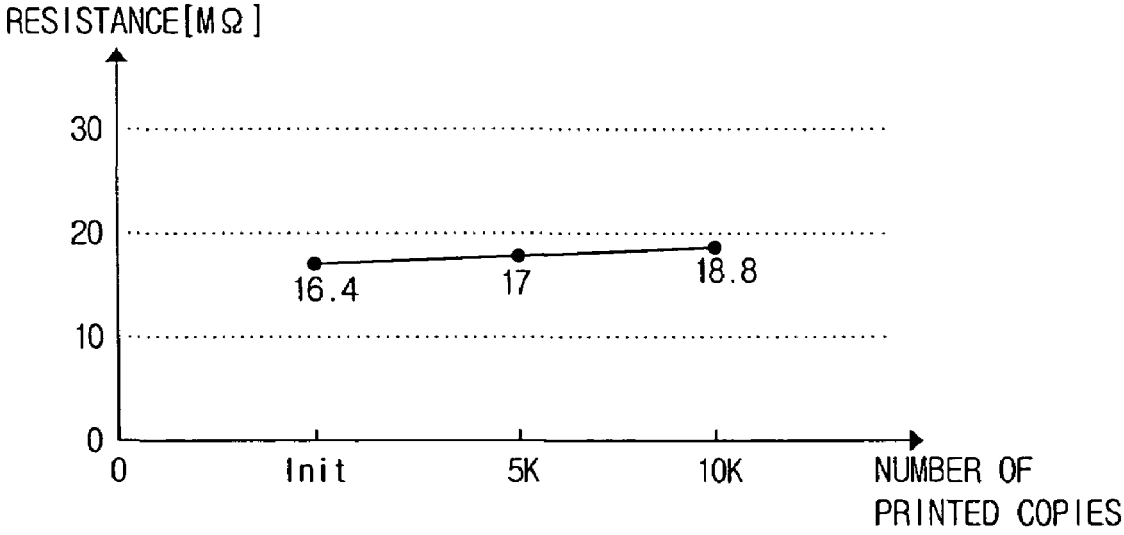
FIG. 10 is graph showing a resistance of an intermediate transfer belt used in the image forming apparatus according to an embodiment of the present invention.

FIG. 10 is a graph showing a relationship between a resistance of the ITB 10 and the number of printed copies of the image forming apparatus according to the present invention. Referring to FIG. 10, a resistance of approximately 16.4 MΩ is measured at an initial state. When the number of printed copies is 5000, the resistance increments to 17 MΩ, and when the number of printed copies approaches is 10000, the resistance increments to 18.8 MΩ. According to the graph of FIG. 10, although the number of printed copies increases, the amount by which the resistance increments is small.

According to the present invention, the refresh charge is supplied to the ITB 10 so that the potential difference generated on the opposite surfaces of the ITB 10 is offset by the refresh charge. Accordingly, the resistance is prevented from being increased due to the potential difference, and thus unnecessary power consumption can be prevented. Also, the lifespan of the ITB can be extended, and the optimal conditions for printing can be satisfied although the number of printed copies increases.

The foregoing embodiment and advantages are merely exemplary and are not to be construed as limiting the present invention. The description of the present invention is intended to be illustrative, and not to limit the scope of the claims. Many alternatives, modifications, and variations will be apparent to those skilled in the art.

What is claimed is:

1. An image forming apparatus to perform a printing job using an intermediate transfer belt, the apparatus comprising:

a refresh charge determination part for determining a level of a refresh charge corresponding to a potential difference which is generated on opposite surfaces of the intermediate transfer belt;

a power supply for supplying the refresh charge to the intermediate transfer belt so that the potential difference is offset;

at least one photoconductor;

at least one first transfer unit for transferring a toner image developed on the at least one photoconductor to a surface of the intermediate transfer belt;

a second transfer unit for transferring the toner image transferred to the surface of the intermediate transfer belt to a paper;

a resistance measurement part for measuring a resistance of the intermediate transfer belt; and a transfer signal determination part for determining a magnitude of a transfer signal, which is supplied to the first transfer unit and the second transfer unit to form an electric field for performing a transferring operation, according to the resistance of the intermediate transfer belt.

2. The image forming apparatus as claimed in claim 1, wherein the refresh charge determination part determines a level of the refresh charge according to the magnitude of the transfer signal determined by the transfer signal determination part.

3. The image forming apparatus as claimed in claim 2, wherein the refresh charge determination part, if the transfer signal is a transfer voltage, determines the level of the refresh charge using the following equation:

$$V_{RV}=V_{T2}/2$$

wherein $V_{RV}$ denotes the level of the refresh charge and $V_{T2}$ denotes a transfer voltage supplied to the second transfer unit.

4. The image forming apparatus as claimed in claim 2, wherein the refresh charge determination part increases the level of the refresh charge if the magnitude of the transfer signal determined by the transfer signal determination part increases, and decreases the level of the refresh charge if the magnitude of the transfer signal determined by the transfer signal determination part decreases.

5. The image forming apparatus as claimed in claim 4, wherein the refresh charge determination part adjusts the level of the refresh charge using the following equation:

$$V_{RV}=V_{old\text{-}RV}\ (\text{at } V_{T1}=V_{old\text{-}T1})$$

$$V_{RV}=V_{old\text{-}RV}-K(V_{T1}-V_{old\text{-}T1})\ (\text{at } V_{T1}<V_{old\text{-}T1})$$

$$V_{RV}=V_{old\text{-}RV}+K(V_{T1}-V_{old\text{-}T1})\ (\text{at } V_{T1}>V_{old\text{-}T1})$$

wherein $V_{T1}$ denotes a transfer voltage supplied to the first transfer unit, $V_{old\text{-}T1}$ denotes a previous transfer voltage supplied to the first transfer unit, $V_{RV}$ denotes the refresh charge, $V_{old\text{-}RV}$ denotes a previous refresh charge, K denotes a proportional constant.

6. The image forming apparatus as claimed in claim 1, further comprising a roller being supplied with the refresh charge from the power supply and transmitting the refresh charge to the intermediate transfer belt.

7. The image forming apparatus as claimed in claim 1, further comprising a pre-cleaning roller for removing toners left on a surface of the intermediate transfer belt, wherein the power supply supplies the refresh charge to the intermediate transfer belt through one of the pre-cleaning roller, the first transfer unit and the second transfer unit, and a predetermined roller being in contact with the intermediate transfer belt so that a potential difference of the intermediate transfer belt is offset.

8. The image forming apparatus as claimed in claim 1, further comprising a memory for storing information about the refresh charge corresponding to the magnitude of the transfer signal, wherein the refresh charge determination part reads out from the memory the refresh charge corresponding to the transfer signal determined by the transfer signal determination part.

9. A transferring method of an image forming apparatus which performs a transferring operation using an intermediate transfer belt, the method comprising:

(a) determining a predetermined level of a refresh charge corresponding to a potential difference which is generated on opposite surfaces of the intermediate transfer belt;

(b) supplying the refresh charge to the intermediate transfer belt so that the potential difference is offset;

(c) measuring a resistance of the intermediate transfer belt;

(d) determining a magnitude of a first transfer signal according to the resistance of the intermediate transfer belt, the first transfer signal being supplied to a first transfer unit for transferring a predetermined toner to a surface of the intermediate transfer belt; and (e) determining a magnitude of a second transfer signal according to the resistance of the intermediate transfer belt, the second transfer signal being supplied to a second transfer unit for transferring the toner transferred to the surface of the intermediate transfer belt to a paper.

10. The method as claimed in claim 9, wherein the step (a) determines the level of the refresh charge according to the magnitude of at least one of the first and the second transfer signals.

11. The method as claimed in claim 10, further comprising:

determining if a variation in the magnitude of the transfer signal has occurred at predetermined intervals;

increasing the level of the refresh charge if the magnitude of the transfer signal increases; and decreasing the level of the refresh charge if the magnitude of the transfer signal decreases.

12. The method as claimed in claim 10, wherein the step (b) supplies the refresh charge to at least one of a pre-cleaning roller for removing a toner left on a surface of the intermediate transfer belt, the first transfer unit, the second transfer unit and a predetermined roller being in contact with the intermediate transfer belt so the a potential difference of the intermediate transfer belt is offset.

13. The method as claimed in claim 10, wherein the step (a) determines the refresh charge using a data table on which information about the refresh charge corresponding to the first transfer signal and the second transfer signal is recorded.

* * * * *